US010342253B2

(12) United States Patent
Le Roux

(10) Patent No.: US 10,342,253 B2
(45) Date of Patent: Jul. 9, 2019

(54) APPARATUS COMPRISING A TIPPING PAPER SUCTION DRUM

(71) Applicant: Tobacco Research and Development Institute (Proprietary) Limited, Stellenbosch (ZA)

(72) Inventor: Gerhard Le Roux, Stellenbosch (ZA)

(73) Assignee: TOBACCO RESEARCH AND DEVELOPMENT INSTITUTE (PROPRIETARY) LIMITED, Stellenbosch (ZA)

( * ) Notice: Subject to any disclaimer, the term of this patent is extended or adjusted under 35 U.S.C. 154(b) by 186 days.

(21) Appl. No.: 15/311,752

(22) PCT Filed: May 14, 2015

(86) PCT No.: PCT/GB2015/051416

§ 371 (c)(1),
(2) Date: Nov. 16, 2016

(87) PCT Pub. No.: WO2015/177516

PCT Pub. Date: Nov. 26, 2015

(65) Prior Publication Data

US 2017/0079320 A1 Mar. 23, 2017

(30) Foreign Application Priority Data

May 20, 2014 (GB) ..... 1408922.1

(51) Int. Cl.
*A24C 5/58* (2006.01)
*A24C 5/47* (2006.01)

(52) U.S. Cl.
CPC ..... *A24C 5/586* (2013.01); *A24C 5/473* (2013.01)

(58) Field of Classification Search
None
See application file for complete search history.

(56) References Cited

U.S. PATENT DOCUMENTS 3,348,552 A 10/1967 McCarthy
4,334,449 A 6/1982 Hinz
(Continued)

FOREIGN PATENT DOCUMENTS

JP 04088975 A 3/1992
WO 2012164067 A2 12/2012

OTHER PUBLICATIONS

International Preliminary Report on Patentability for corresponding application PCT/GB2015/051416 filed May 14, 2015; dated Aug. 10, 2016.

(Continued)

*Primary Examiner* — Michael J Felton
*Assistant Examiner* — Katherine A Will
(74) *Attorney, Agent, or Firm* — Cantor Colburn LLP

(57) ABSTRACT

Apparatus comprising a tipping paper suction drum (10) adapted to receive a web (13) of tipping paper which is cut on the tipping paper suction drum to form successive patches (8) of tipping paper for wrapping smoking articles. The tipping paper suction drum is adapted to rotate at a speed greater than the speed at which the web of tipping paper is fed onto the tipping paper suction drum such that spaces are formed between the cut patches of tipping paper. A peripheral surface (14) of the tipping paper suction drum has suction holes (16) arranged to pull the leading portion of the web of tipping paper towards the surface of the tipping paper suction drum in the time between successive cuts.

14 Claims, 7 Drawing Sheets

(56) References Cited

U.S. PATENT DOCUMENTS

| | | | | |
|---|---|---|---|---|
| 6,425,323 | B1 * | 7/2002 | Steuer | B65H 20/12 100/155 R |
| 2004/0123710 | A1 | 7/2004 | Rizzoli | |

OTHER PUBLICATIONS

International Search Report for corresponding application PCT/GB2015/051416 filed May 14, 2015; dated Aug. 17, 2015.
Response to the Written Opinion of the International Preliminary Examining Authority for corresponding application PCT/GB2015/051416 filed May 14, 2015; Report dated Jun. 8, 2016.
Written Opinion of the International Search Authority for corresponding application PCT/GB2015/051416 filed May 14, 2015; dated Aug. 17, 2015.
Japanese Office Action for corresponding application 2016-568426; Office Action dated Nov. 14, 2017.

* cited by examiner

APPARATUS COMPRISING A TIPPING PAPER SUCTION DRUM

TECHNICAL FIELD

The present invention relates to apparatus comprising a tipping paper suction drum for assembling smoking articles, such as cigarettes.

BACKGROUND

Apparatus for assembling cigarettes attaches two tobacco rods to each end of a filter rod by wrapping a patch of tipping paper around a collation of tobacco and filter rods. The wrapped collation is then cut through the filter rod to produce two cigarettes.

In such apparatus, a web of tipping paper is fed onto a tipping paper suction drum and is cut into patches. The cut patches are then transferred to a rolling mechanism that wraps each cut patch around a collation of filter and tobacco rods to form cigarettes.

SUMMARY OF THE INVENTION

In accordance with embodiments of the invention, there is provided apparatus comprising a tipping paper suction drum adapted to receive a web of tipping paper which is cut on the tipping paper suction drum to form successive patches of tipping paper for wrapping smoking articles, the tipping paper suction drum being adapted to rotate at a speed greater than the speed at which the web of tipping paper is fed onto the tipping paper suction drum such that spaces are formed between the cut patches of tipping paper, wherein a peripheral surface of the tipping paper suction drum comprises suction holes arranged to pull the leading portion of the web of tipping paper towards the peripheral surface of the tipping paper suction drum in the time between successive cuts.

The apparatus may further comprise a rotary cutting unit arranged to cut the tipping paper against the peripheral surface of the tipping paper suction drum. The tipping paper suction drum and cutting unit may be configured to operate in synchronicity such that patches having regular size are cut on the tipping paper suction drum and the cut patches are equally spaced.

The apparatus may further comprise a suction control component adapted to deactivate suction through said suction holes as they move past the leading edge of the web of tipping paper.

The suction holes may comprise first suction holes to retain cut patches of tipping paper, and second suction holes to pull the leading portion of the web of tipping paper towards the peripheral surface of the tipping paper suction drum in the time between successive cuts.

The suction control component may be adapted so that for at least certain times during rotation of the tipping paper suction drum, suction is applied to either the first suction holes or to the second suction holes.

The suction control component may also be adapted to provide gaseous flow to the suction holes to push the cut patches of tipping paper away from the peripheral surface of the tipping paper suction drum.

Each of the first and second suction holes may be connected to a suction channel that extends to a second surface of the tipping paper suction drum.

Each suction channel may be connected to a row of suction holes extending across the peripheral surface of the tipping paper suction drum.

The suction control component may be disposed at the second surface to provide suction to the suction channels.

In one example, the second surface may be an end face of the tipping paper suction drum and the suction control component may be disposed at the end face of the tipping paper suction drum such that the tipping paper suction drum rotates relative to the suction control component.

In another example, the second surface may be an internal surface of the tipping paper suction drum, for example an inner cylindrical surface, and the suction control. component may be disposed within the tipping paper suction drum, for example within an internal cylindrical space in the tipping paper suction drum, such that the tipping paper suction drum rotates relative to the suction control component.

The suction channels may be arranged on a pitch circle diameter on the end face of the tipping paper suction drum, and the suction control component may comprise a recess that is aligned with suction channels.

Suction channels that are connected to the first suction holes may be disposed on a different pitch circle diameter to suction channels that are connected to the second suction holes.

In one example, the tipping paper suction drum may comprise a plurality of segments that form the peripheral surface of the tipping paper suction drum, and the segments may comprise cutting edges adapted to cooperate with a shear cutter to cut the web on the tipping paper suction drum.

In this example, each segment has a configuration of suction channels that can be selectively closed/opened to vary the suction control for that segment.

At least some suction holes of each segment may be connected to both first suction channels and second suction channels, such that said suction holes can be configured to act as first suction holes or second suction holes.

The suction channels may be selectively closed by a removable blocking member, for example a grub screw, bolt, cap, cover, lid, or insert.

In one example, a patch of tipping paper may extend over two adjacent segments, with each successive patch being cut against the cutting edge of alternate segments.

In a first example configuration of suction channels, the second suction channels of a first segment may be closed while the first suction channels are open, so that the suction holes of the first segment are configured to act as first suction holes. Also, in the first configuration of suction channels, at least one first suction channel of a second segment may be closed and at least one second suction channel of that second segment may be open, so that the second segment is configured to have first suction holes and second suction holes.

In a second example configuration of suction channels, the second suction channels of a second segment may be closed while the first suction channels are open, so that the suction holes of the second segment are configured to act as first suction holes. Also, in the first configuration of suction channels, at least one first suction channel of a first segment may be closed and at least one second suction channel of that first segment may be open, so that the first segment is configured to have first suction holes and second suction holes.

According to another aspect of the invention, there is provided a module of a modular apparatus for assembling smoking articles, comprising the apparatus described above.

According to another aspect of the invention, there is provided apparatus for assembling smoking articles comprising the apparatus or the module described above.

According to another aspect of the invention, there is provided a smoking article assembled using the apparatus.

According to embodiments of the invention, there is also provided a method of assembling smoking articles comprising:

feeding a web of tipping paper onto a tipping paper suction drum;

cutting said web to form successive patches;

rotating the tipping paper suction drum at a speed greater than the speed at which the web of tipping paper is fed onto the tipping paper suction drum such that spaces are formed between the cut patches of tipping paper;

applying suction to pull the leading portion of the web of tipping paper towards the peripheral surface of the tipping paper suction drum in the time between successive cuts; and, assembling a smoking article using a patch cut from the web.

The method may further comprise the step of deactivating the suction holes associated with the leading portion of the web of tipping paper as they become exposed.

According to another aspect of the invention, there is provided a smoking article assembled by the method described above.

BRIEF DESCRIPTION OF THE DRAWINGS

Embodiments of the invention will now be described, by way of example only, with reference to the accompanying drawings, in which.

DETAILED DESCRIPTION

Figure 1:
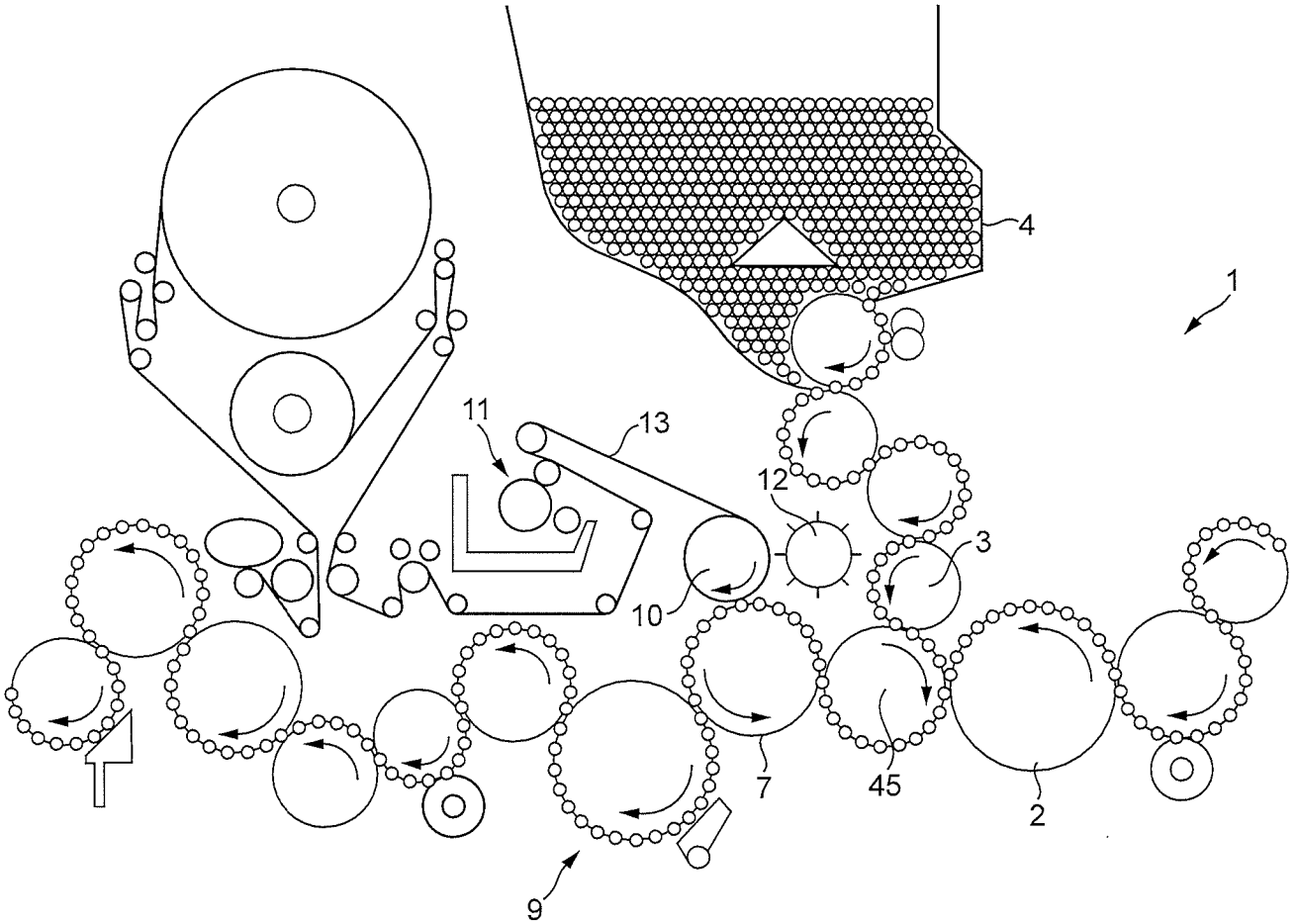
FIG. 1 shows a part of a smoking article assembly apparatus 1.

FIG. 1 shows an example of smoking article assembly apparatus 1. The apparatus includes a tobacco rod feed drum 2 and a filter rod feed drum 3. The tobacco rod feed drum 2 receives wrapped tobacco rods that are travelling in a direction transverse to their length (i.e. sideways) in flutes formed in the peripheral surface of the tobacco rod feed drum 2. The filter rod feed drum 3 receives filter rods from a hopper 4. The filter rod feed drum 3 the tobacco rod feed drum 2 feed filter rods and tobacco rods, respectively, onto a combining drum 45, such that the filter rods and tobacco rods are axially aligned in the flutes on the peripheral surface of the combining drum 45, ready to be wrapped to form an assembled smoking article.

In one example explained in more detail with reference to FIG. 2, two tobacco rods 5 are positioned in each flute on the combining drum (45, see FIG. 1) and one double-length filter rod 6 is positioned between the two tobacco rods 5, in the same flute.

Figure 2:
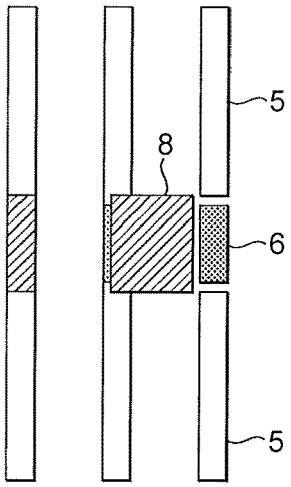
FIG. 2 shows a schematic illustration of how the smoking articles are assembled.

Referring to FIGS. 1 and 2, the combining drum 45 also has a swash plate not shown) that pushes the tobacco rods 5 and filter rod 6 together so that one end of each tobacco rod 5 abuts an end of the filter rod 6. The tobacco rods 5 and filter rod 6 are then transferred from the combining drum 45 onto a tipping drum 7 where they are provided with a tipping paper patch 8 before being transferred to a rolling unit 9 that roils the tipping paper patch 8 around the tobacco and filter rods 5, 6 to form two assembled cigarettes in back-to-back arrangement. The tipping, paper patch 8 is supplied to the tipping drum 7 by a tipping paper suction drum 10.

A web 13 of tipping paper passes through an adhesive applicator 11 that applies adhesive to one surface of the tipping paper web 13. The tipping paper web 13 is then received on the tipping paper suction drum 10, which uses suction to hold the web 13 of tipping paper against the peripheral surface of the tipping paper suction drum 10. A cutting unit 12 cuts the web 13 of tipping paper into patches 8 on the tipping paper suction drum 10 and the patches are then transferred to the tobacco and filter rods 5, 6 on the tipping drum 7.

In one example, the cutting unit 12 comprises a crush cutter. In this case, the cutting unit 12 comprises a rotary blade and the tipping paper suction drum 10 acts as an anvil against which the tipping paper web 13 is cut by the rotary blade, in a transverse direction (i.e. across the web 13), to form patches 8 of tipping paper. The cutting unit 12 may have several rotary blades which protrude from a shaft in a radial direction so that as the shaft rotates the blades successively come into contact with the peripheral surface of the tipping paper suction drum 10 and cut the web 13 in a transverse direction (i.e. in the axial direction of the tipping paper suction drum 10 and cutting unit 12).

In another embodiment, the cutting unit 12 uses a shear cutter to cut the web 13. This embodiment is described in more detail with reference to FIG. 9.

The cut patches 8 of tipping paper on the tipping paper suction drum 10 already have adhesive applied to their outwards facing surface, so at the position where the tipping paper suction drum 10 rotates closest the tipping drum 7 the suction acting on the tipping paper patches 8 is released and the patches 8 are transferred from the tipping paper suction drum 10 to the tipping drum 7, specifically onto the tobacco and filter rods 5, 6. The adhesive anchors the tipping paper patches 8 to the tobacco and filter rods 5, 6.

The tipping drum 7 then transfers the tobacco and filler rods 5, 6 and the tipping paper patch into the rolling unit 9 that rolls the tipping paper patch 8 around the tobacco and filter rods 5, 6 to form cigarettes. The rolled cigarettes are then conveyed for packaging.

FIG. 2 shows a schematic diagram of a two-up cigarette assembly process, as briefly described above. The process steps are successively shown from right to left. The first stage is to position two tobacco rods 5 and a filter rod 6 in a flute of the combining drum (45, see FIG. 1). Once these rods 5, 6 are positioned in the flute a swash plate pushes them towards each other so that an end of each tobacco rod 5 abuts an end of the filter rod 6 and the collation is centralised on the combining drum (45, see FIG. 1) and appropriately aligned to downstream apparatus. The aligned and abutting tobacco and filter rods 5, 6 are then transferred to a flute on the tipping drum (7, see FIG. 1).

Next, a tipping paper patch 8 is provided by the tipping paper suction drum (to, see FIG. 1). The tipping paper patch 8 overlies the entire filter rod 6 and an end region of each tobacco rod 5. As described with reference to FIG. 1, the tipping paper patch 8 has adhesive applied to one surface which is in contact with the tobacco and filter rods 5, 6, so that the tipping paper patch 8 is anchored to the tobacco and filter rods 5, 6 by the adhesive.

Next, the collation of tobacco rods 5, filter rod 6 and tipping paper patch 8 is rolled by the rolling unit (9, see FIG. 1) so that the tipping paper patch 8 is wrapped around the tobacco and filter rods 5, 6 and two cigarettes are formed in joined end-to-end relationship. This 'two-up' cigarette can subsequently be cut through the filter rod 6 to form two cigarettes. A suitable rolling unit will be known by a person who is familiar with cigarette assembly apparatus.

Figure 3:
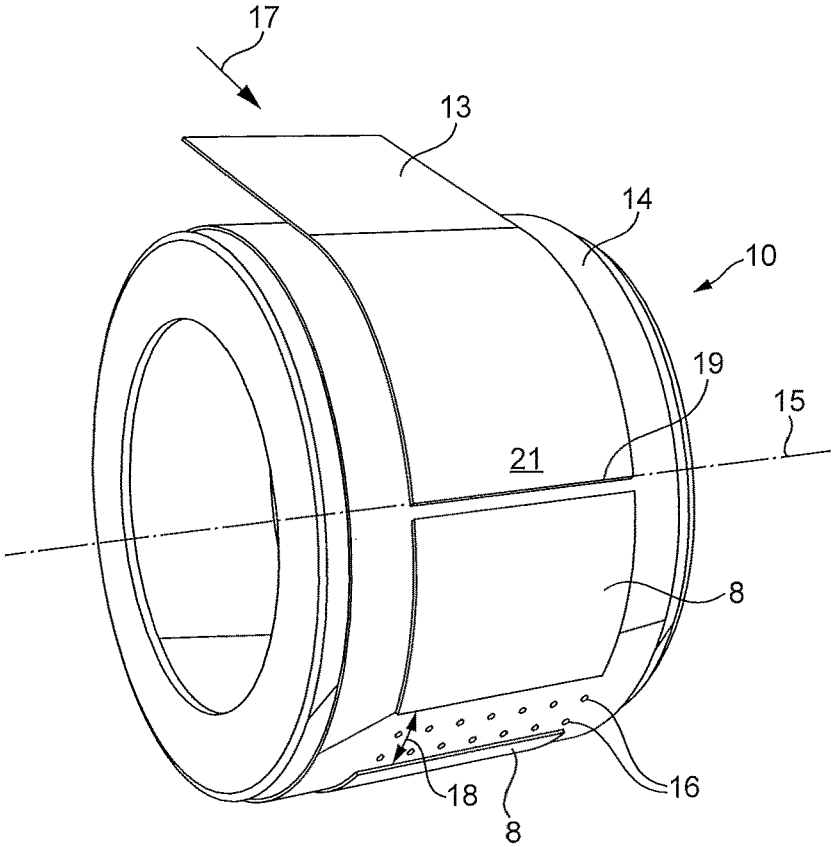
FIG. 3 shows a perspective view of a tipping paper suction drum 10 of the smoking article assembly apparatus of FIG. 1.
Figure 4:
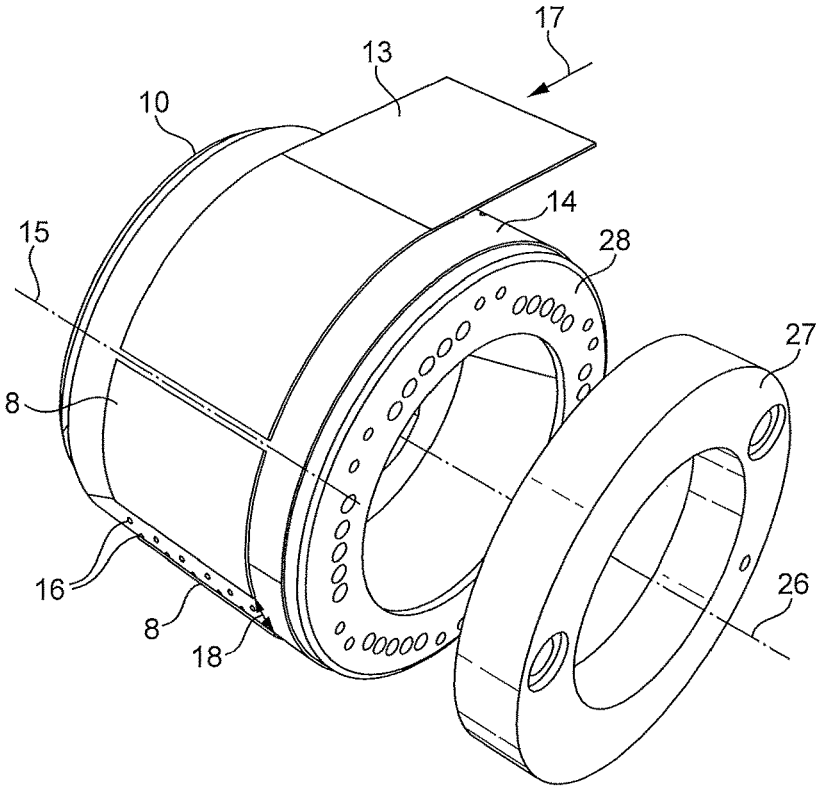
FIG. 4 shows a perspective view of the tipping paper suction drum 10 of FIG. 3 and a suction control component 27.

FIGS. 3 and 4 show an example of the tipping paper suction drum 10 described with reference to the smoking article assembly apparatus 1 of FIG. 1. The tipping paper web 13 is fed onto the tipping paper suction drum 10 in the direction of arrow 17 and is received against a peripheral surface 14 of the tipping paper suction drum 10 and cut by the cutting unit (12, see FIG. 1), in the position indicated by line 15, to form successive patches 8 that are retained on the tipping paper suction drum 10 before being transferred to the tipping drum (7, see FIG. 1). Suction is supplied to suction holes 16 on the peripheral surface 14 of the tipping paper suction drum 10 to pull the web 13 and cut patches 8 of tipping paper onto the peripheral surface 14 of the tipping paper suction drum 10.

As shown in FIG. 4, a suction control component 27 is arranged to provide suction to the suction holes 16 of the tipping paper suction drum 10 during a part of the rotation of the tipping paper suction drum 10, so that the cut patches 8 are retained on the peripheral surface 14 during that part of rotation of the tipping paper suction drum 10, and then released. The suction control component 27 can be arranged to deactivate the suction holes 16 when the tipping paper patches 8 reach the position to be released onto the tipping drum (7, see FIG. 1).

Also shown in FIGS. 3 and 4, a space 18 is formed between each cut patch 8 on the tipping paper suction drum 10.

The space 18 between each patch 8 is achieved by rotating the tipping paper suction drum 10 at a speed greater than the speed at which the web 13 of tipping paper is fed onto the tipping paper suction drum 10, such that a space 18 is formed between successive cut patches 8 of tipping paper. Specifically, the linear speed of the peripheral surface 14 of the tipping paper suction drum 10 is greater than the linear speed of the web 13. In this way, as each patch 8 is cut by the cutting unit (12, see FIG. 1) the tipping paper suction drum 10 carries that patch 8 away from the leading edge 19 of the web 13. The peripheral surface 14 of the tipping paper suction drum 10 will slide relative to the web 13 and the cutting unit (12, see FIG. 1) is arranged to cut each patch 8 at the appropriate time so that cut patches 8 are retained on the tipping paper suction drum 10 in the spaced arrangement shown in FIGS. 3 and 4.

As shown in FIG. 4, the suction control component comprises a suction ring 27 arranged to provide suction to the suction holes 16 of the tipping paper suction drum to, as described in more detail with reference to FIGS. 5 to 9. For clarity, in FIG. 4 the suction ring 27 is shown spaced from the tipping paper suction drum 10, but in operation the suction ring 27 will be disposed close to, or abut, the end face 28 of the tipping paper suction drum 10, as will become apparent hereinafter. The tipping paper suction drum 10 rotates about axis 26 and the suction ring 27 is fixedly mounted so that the tipping paper suction drum 10 rotates relative to the suction ring 27. The suction ring 27 and/or tipping paper suction drum 10 may be provided with a seal (not shown) such that the interface between the tipping paper suction drum 10 and the suction ring 27 is sealed during rotation of the tipping paper suction drum 10 relative to the suction ring 27.

Figure 5:
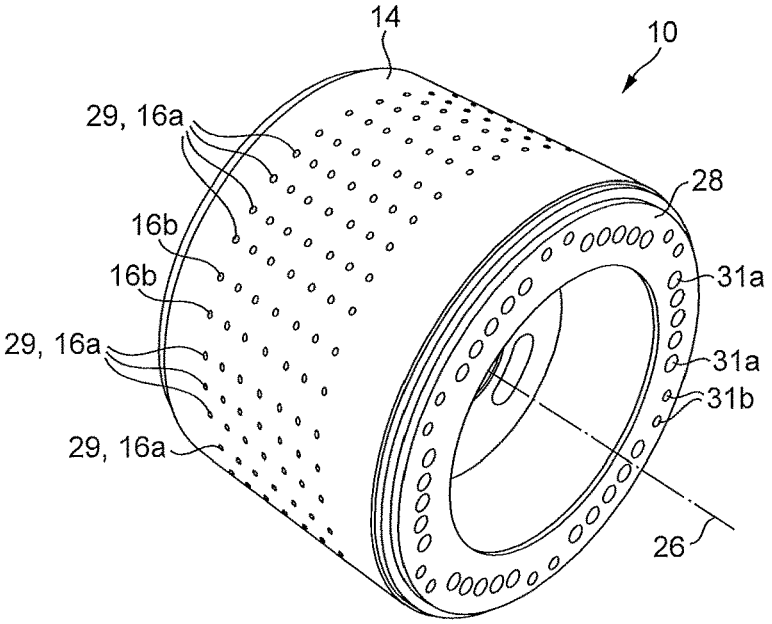
FIG. 5 shows a perspective view of the tipping paper suction drum 10 of FIG. 3.

FIG. 5 shows the tipping paper suction drum 10 of FIGS. 3 and 4 and, as shown, suction holes 16 are arranged as a series of rows extending across the peripheral surface 14 of the tipping paper suction drum 10. In this example, the rows of suction holes 16 are regularly equispaced, meaning that each row is spaced from the next row by the same distance. However, it will be appreciated that in other embodiments the rows of suction holes 16 may be irregularly spaced. The suction holes 16 are divided into rows of first suction holes 16*a* and rows of second suction holes 16*b*.

The first suction holes 16*a* are provided to hold the cut patches (8, see FIGS. 3 and 4) of tipping paper against the peripheral surface 14 of the tipping paper suction drum 10 and transport them to the point that they are transferred to the tipping drum (7, see FIG. 1).

The first suction holes 16*a* are arranged as several spaced arrays 29 of first suction holes 16*a*, each array 29 corresponding to the position in which a patch 8 is retained after being cut. The cutting unit (12, see FIG. 1) and tipping paper suction drum 10 are configured to operate in synchronicity, such that each patch 8 is cut at the time it is aligned with the corresponding array 29 of first suction holes 16*a*. In this way, an array 29 of first suction holes 16*a* is covered by a single patch 8 and that patch 8 is retained on the peripheral surface 14 of the tipping paper suction drum 10.

The second suction holes 16*b* are provided to pull the leading edge portion 21 of the web 13 of tipping paper against the peripheral surface 14 of the tipping paper suction drum 10 in the time between successive cuts being made.

The tipping paper suction drum 10 has a series of suction channels 31 that are connected to the suction holes 16 and extend to an end face 28 of the tipping paper suction drum 10. The suction channels 31 are arranged such that one suction channel 31 is connected to a row of suction holes 16 extending in the axial direction across the peripheral surface 14 of the tipping paper suction drum 10.

The suction channels 31 are divided into first suction channels 31*a* and second suction channels 31*b*. Each first suction channel 31*a* is connected to a row of first suction holes 16*a* on the peripheral surface 14 of the tipping paper suction drum 10. Each second suction channel 31*b* is connected to a row of second suction holes 16*b* on the peripheral surface 14 of the tipping paper suction drum 10.

As described in more detail with reference to FIGS. 6 to 9, the configuration of the suction ring 27 dictates when suction is applied to the first suction channels 31*a* and the second suction channels 31*b*, and therefore when suction is applied to the first suction holes 16*a* and the second suction holes 16*b* as the tipping paper suction drum 10 rotates.

As shown in FIG. 5, the first suction channels 31*a* are disposed on a different pitch circle diameter (relative to the rotational axis 26 of the tipping paper suction drum 10) to the second suction channels 31*b*.

The second suction channels 31*b* and second suction holes 16*b* are disposed in between spaced arrays 29 of first suction channels 31*a* and first suction holes 16*a*. In this example, the second suction channels 31*b* are formed on a pitch circle diameter greater than the first suction channels 31*a* on the end face 28 of the tipping paper suction drum 10.

As described below, providing the first suction channels 31*a* at different pitch circle diameter to the second suction Channels 31*b* makes it possible to activate and deactivate the suction applied to the first and second suction holes 16*a*, 16*b* at different points of rotation of the tipping paper suction drum 10. This allows suction to be applied to the leading edge portion (21, see FIG. 3) of the web (13, see FIG. 3) in the time between successive cuts.

It will be appreciated that in an alternative example the second suction holes 31*b* could be formed on a pitch circle diameter that is smaller than the pitch circle diameter of the first suction holes 31*a*.

Figure 7:
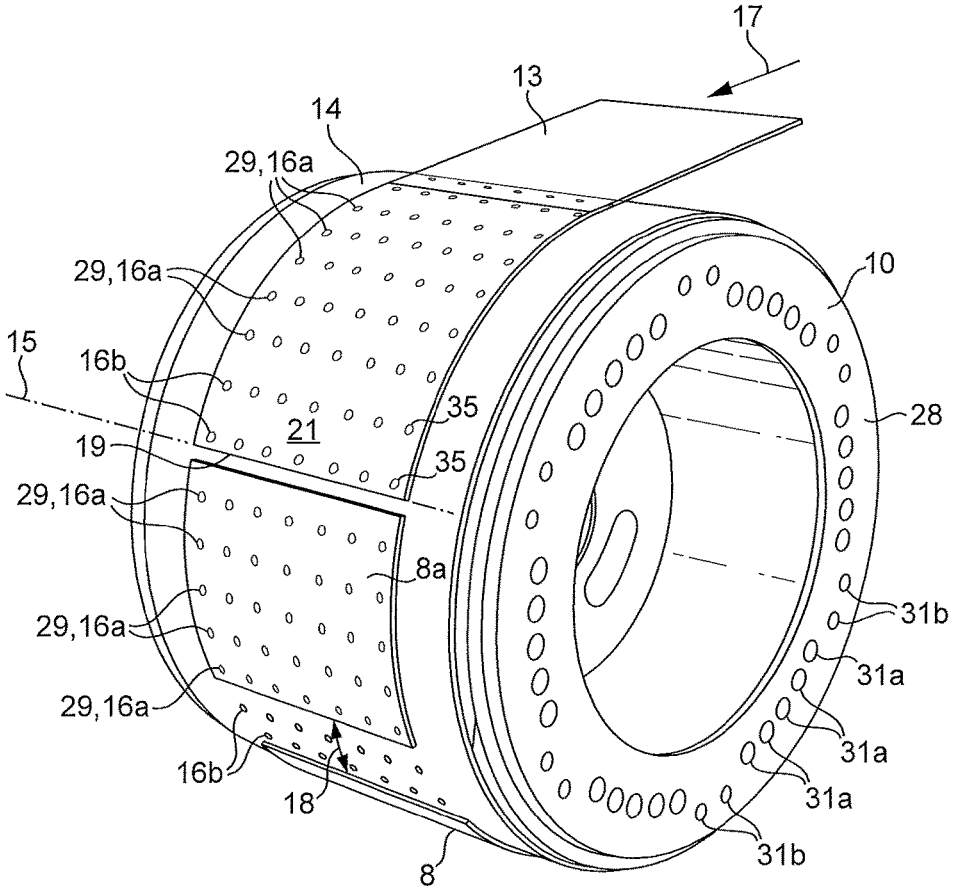
FIG. 7 shows the tipping paper suction drum 10 of FIG. 3, with the tipping paper web 13 shown as transparent.

FIG. 7 shows the tipping paper suction drum 10, the web 13 of tipping paper being fed onto the tipping paper suction drum 10 in the direction of arrow 17, and the position at which the web 13 is cut, indicated by line 15. As previously explained, a space 18 is formed between each cut patch 8 of tipping paper on the tipping paper suction drum 10, before being transferred to the tipping drum (7, see FIG. 1).

FIG. 7 also shows the arrangement of the first and second suction channels 31*a*, 31*b* and first and second suction holes 16*a*, 16*b* in relation to the cutting position 15 and the space 18 created between successive patches 8.

The first suction holes 16*a* are disposed in arrays 29 where the cut patches 8 of the tipping paper 8 are carried on the peripheral surface 14 of the tipping paper suction drum 10. The second suction holes 16*b* are arranged in between the arrays 29 of the first suction holes 16*a*. Therefore, as shown in FIG. 7, the second suction holes 16*b* pull the leading edge portion 21 of the web 13 against the peripheral surface 14 of the tipping paper suction drum 10 in the time between successive cuts.

Specifically, FIG. 7 shows the situation shortly after a cut has been made to form patch 8*a*. As shown, in this position, two rows 35 of second suction holes 16*b* are aligned with the leading edge portion 21 of the tipping paper web 13 to pull the leading edge portion 21 of the web 13 towards the peripheral surface 14 of the tipping paper suction drum 10.

Figure 6:
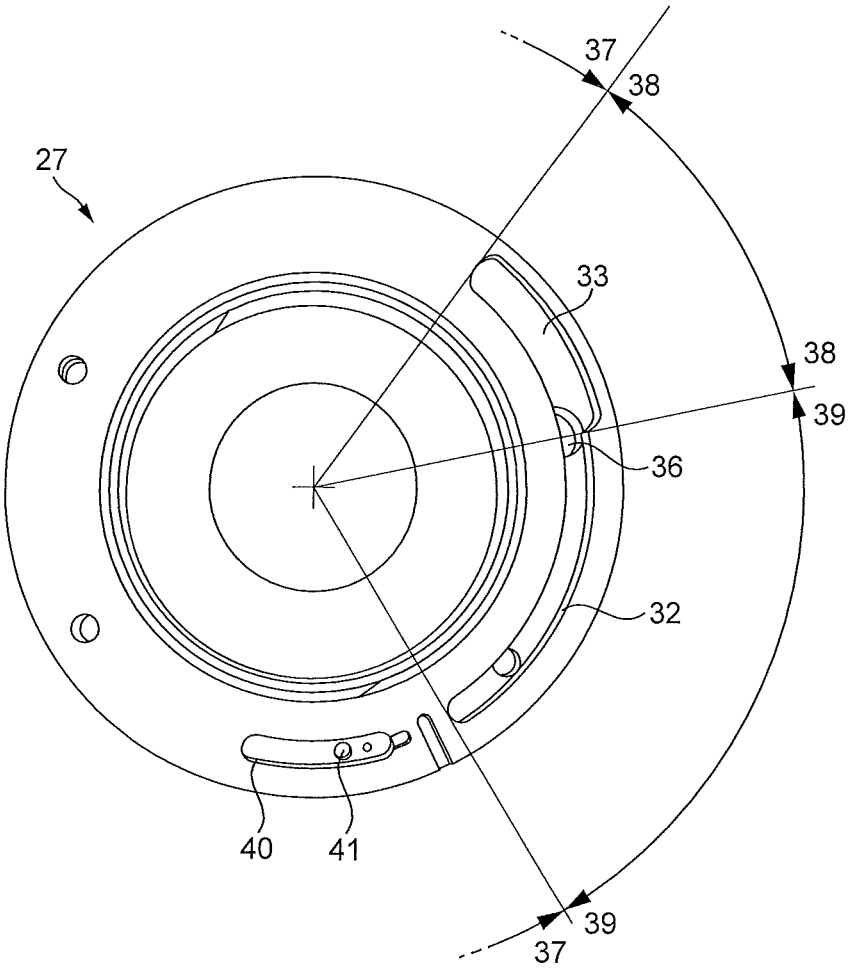
FIG. 6 shows the suction control component 27.

However, as the tipping paper suction drum 10 is rotating at a greater speed than the web 13 of tipping paper is travelling, these two rows 35 of second suction holes 16*b* will become exposed before the next patch is cut. As will now be described, the suction ring 27 shown in FIGS. 4 and 6 is configured to deactivate the suction applied to these two rows 35 of second suction holes 16*b* before they become exposed.

Referring again to FIGS. 4 to 7, the suction ring 7 includes a first recess 32 that extends circumferentially around the suction ring 27. The first recess 32 is formed at a pitch circle diameter equal to that of the first suction channels 31*a* in the tipping paper suction drum 10. The first recess 32 has a suction supply port 36 which is connected to a suction pump or low pressure source, so that suction is applied to the first recess 32. Therefore, first suction channels 31*a* that are aligned with the first recess 32 will be provided with suction. As the tipping paper suction drum 10 rotates the first suction channels 31*a* will move into and oat of alignment with the first recess 32 and suction through the first suction holes 16*a* will be sequentially activated and then deactivated.

The suction ring 27 has a second recess 33 that, in this embodiment, is joined to the first recess 32 such that the second recess 33 is an enlarged region of the first recess 32. However, as will become apparent, the second recess 33 may be separate to the first recess 32. In either case, the second recess 33 is provided with suction via the suction supply port 36 of the first recess 32 or via an additional suction supply port.

The second recess 33 extends partially around the suction ring 27 in a circumferential direction at a pitch circle diameter equivalent to the second suction channels 31*b* on the tipping paper suction drum 10. Therefore, second suction channels 31*b* that are aligned with the second recess 33 will be provided with suction. As the tipping paper suction drum 10 rotates the second suction channels 31*b* will move into and out of alignment with the second recess 33 and suction through the second suction holes 16*b* will be sequentially activated and then deactivated.

The first recess 32 and the second recess 33 are formed at different pitch circle diameters and extend partially around the suction ring 27 in a circumferential direction. Therefore, the tipping paper suction drum has three distinct regions of rotation:

1. a first region 37 where the first suction channels 31*a* are not aligned with the first recess 32 and the second suction channels 31*b* are not aligned with the second recess 33, so no suction is applied to the first or second suction holes 16*a*, 16*b;*
2. a second region 38 where the first and second suction channels 31*a*, 31*b* are aligned with the first and second recesses 32, 33 respectively, such that suction is applied to both the first and second suction holes 16*a*, 16*b*; and,
3. a third region 39 where the first suction channels 31*a* are aligned with the first recess 32, so that suction is applied to the first suction holes 16*a*, and the second suction channels 31*b* are not aligned with the second recess 33, so that no suction is applied to the second suction holes 16*b*.

It will be appreciated that the first and second suction holes 16*a*, 16*b* alternate around the peripheral surface 14 of the tipping paper suction drum 10, so at a position where one of the first suction holes 16*a* is positioned within the first region 37, another of the first suction holes 16*a* may at the same time be positioned within the second region 38 or the third region 39.

In the manner described above, as the tipping paper suction drum 10 rotates the first and second suction channels 31*a*, 31*b* move into and out of alignment with the first and second recesses 32, 33 respectively, and suction is either activated or deactivated for the first and second suction holes.

The suction ring 27 also has a third recess 40, which has a compressed air supply port 41 that connects the third recess 40 to a pressure source, for example a compressed air reservoir and/or pump. The third recess 40 lies on the same pitch circle diameter as the first recess 32 such that as the first suction channels 31*a* rotate past the third recess 40 a gaseous flow is created through the first suction channels 31*a* and first suction holes 16*a*, which ads to push the tipping paper patches 8 away from the peripheral surface 14 of the tipping paper suction drum 10. The gaseous flow provided by the third recess 40 can be used to aid the transfer of the tipping paper patches 8 from the tipping paper suction drum 10 to the tipping drum (7, see FIG. 1).

Figure 8:
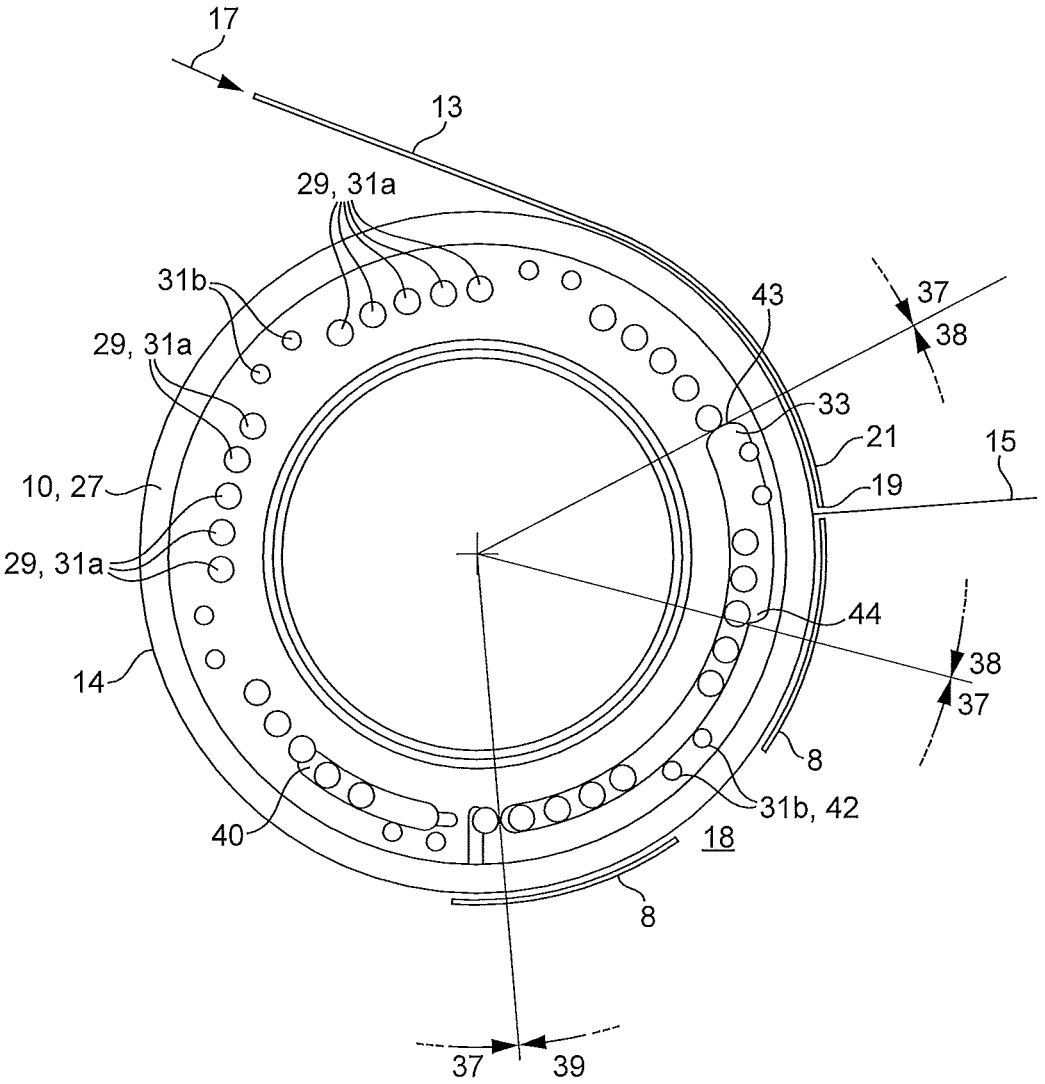
FIG. 8 shows a schematic side view of the toning paper suction drum 10, suction ring 27, and tipping paper web 13; and, FIG. 9 shows a perspective view of a tipping paper suction drum 10 having segments 45 for shear cutting.

FIG. 8 shows a schematic view of the tipping paper suction drum 10 and suction ring 27 such that the relative positions of the first recess 32, second recess 33, third recess 40 and first and second suction channels 31*a*, 31*b* can be determined. As explained, the suction channels 31*a*, 31*b* are aligned with the suction holes (16*a*, 16*b*, see FIGS. 5 and 7) with which they correspond, so the suction holes can be considered to be aligned with the suction channels 31*a*, 31*b* shown in FIG. 8.

The first suction channels 31*a* are disposed on the end face 28 of the tipping paper suction drum 10 at a first pitch circle diameter and the second suction channels 31*b* are disposed between the arrays 29 of first suction Channels 31*a* and at a different, in this case larger, pitch circle diameter to the first suction channels 31*a*. Therefore, the first suction channels 31*a* will move into and out of alignment with the first recess 32 as the tipping paper suction drum 10 rotates relative to the suction ring 27. Meanwhile, the second suction channels 31*b* will move into and out of alignment with the second recess 33 as the tipping paper suction drum 10 rotates relative to the suction ring 27. Furthermore, the first suction channels 31*a* will move into and out of alignment with the third recess 40 as the tipping paper suction drum 10 rotates relative to the suction ring 27.

FIG. 8 also shows the tipping paper web 13 and its direction of travel indicated by arrow 17, the cutting position 15, and cut patches 8 which are on the tipping paper suction drum 10. As shown, two of the second suction channels 31*b* indicated by reference numeral 35, and therefore the associated second suction holes, are aligned with the leading edge portion 21 of the tipping paper web 13 after a cut is made. Then, as the tipping paper suction drum 10 rotates faster than the web 13 is being fed onto the tipping paper suction drum 10, those second suction channels 35 will overtake the leading edge 19 of the web 13. The result is that those second suction channels 35 and the associated second suction holes are disposed in the space 18 between two cut patches 8. As an example, this situation is shown in FIG. 8 in respect of the next pair of second suction channels 31*b* on the tipping paper suction drum 10, indicated by reference numeral 42.

The second recess 33 is arranged to activate suction in the second suction channels 31*b* and second suction holes in the time between successive cuts.

The second recess 33 is arranged such that the suction in the second suction channels 31*b* and second suction holes is deactivated as, or immediately before, the leading edge 19 of the web 13 is overtaken by those second suction holes 31*b*, i.e. before the second suction holes 16*b* become exposed.

To achieve this, the second recess 33 extends partially around the suction ring 27 from a first end 43, which is positioned before (i.e. upstream of) the cut position 15, to a second end 44, which is positioned after (i.e. downstream of) the cut position 15 and located such that the leading edge portion 21 of the web 13 of tipping paper always covers any second suction holes (16*b*, see FIG. 7) in this location. Therefore, the suction applied to the second suction channels 31*b* and second suction holes (16*b*, see FIG. 7) is deactivated before those second suction holes (16*b*, see FIG. 7) pass or overtake the leading edge 19 of the tipping paper web 13 and become exposed. Deactivating the suction of the second suction holes (16*b*, see FIG. 7) at the appropriate time, before they become exposed, prevents any suction being wasted, which can cause lack of suction in other suction holes, increased energy consumption, and increased noise.

FIG. 8 therefore shows the first region 37, the second region 38, and the third region 39 of rotation of the tipping paper suction drum 10, as described with reference to FIG. 6.

As described above with reference to FIGS. 3 to 8, the second suction holes 16*b* act to pull the leading edge portion 21 of the tipping paper web 13 against the peripheral surface 14 of the tipping paper suction drum 10 in the time between successive cuts. This occurs in the second region 38 of rotation of the tipping paper suction drum 10. However, as the tipping paper suction drum 10 is rotating faster than the web 13 is moving the second suction holes 16*b* will move past, i.e. overtake, the leading edge 19 of the web 13. As this happens, the second suction channels 31*b* reach the second end 44 of the second recess 33 and move into the third region 39 of rotation of the tipping paper suction drum 10, where the suction being supplied to the second suction channels 31*b* and second suction holes 16*b* is deactivated.

Also shown in FIG. 8, once a tipping paper patch 8 enters the third region 39 of rotation of the tipping paper suction drum 10 it is retained on the peripheral surface 14 of the tipping paper suction drum 10 by the first suction holes (16*a*, see FIG. 7) being supplied with suction via the first suction channels 31*a* and first recess 32. Then, as those first suction channels 31*a* pass the end of the first recess 32 the suction is deactivated and the tipping paper patch 8 is no longer retained on the tipping paper suction drum 10—it is transferred to the tipping drum (7, see FIG. 1).

Moreover, shortly after passing the end of the first recess 32 those first suction channels 31*a* will become aligned with the third recess 40, which provides a gaseous flow through the first suction channels 31*a* and first suction holes (16*a*, see FIG. 7) to push the tipping paper patch 8 away from the tipping paper suction drum 10 and onto the tipping drum (7, see FIG. 1).

Therefore, the tipping paper patches 8 are quickly and accurately transferred from the tipping paper suction drum 10 the tipping drum (7, see FIG. 1).

Figure 9:
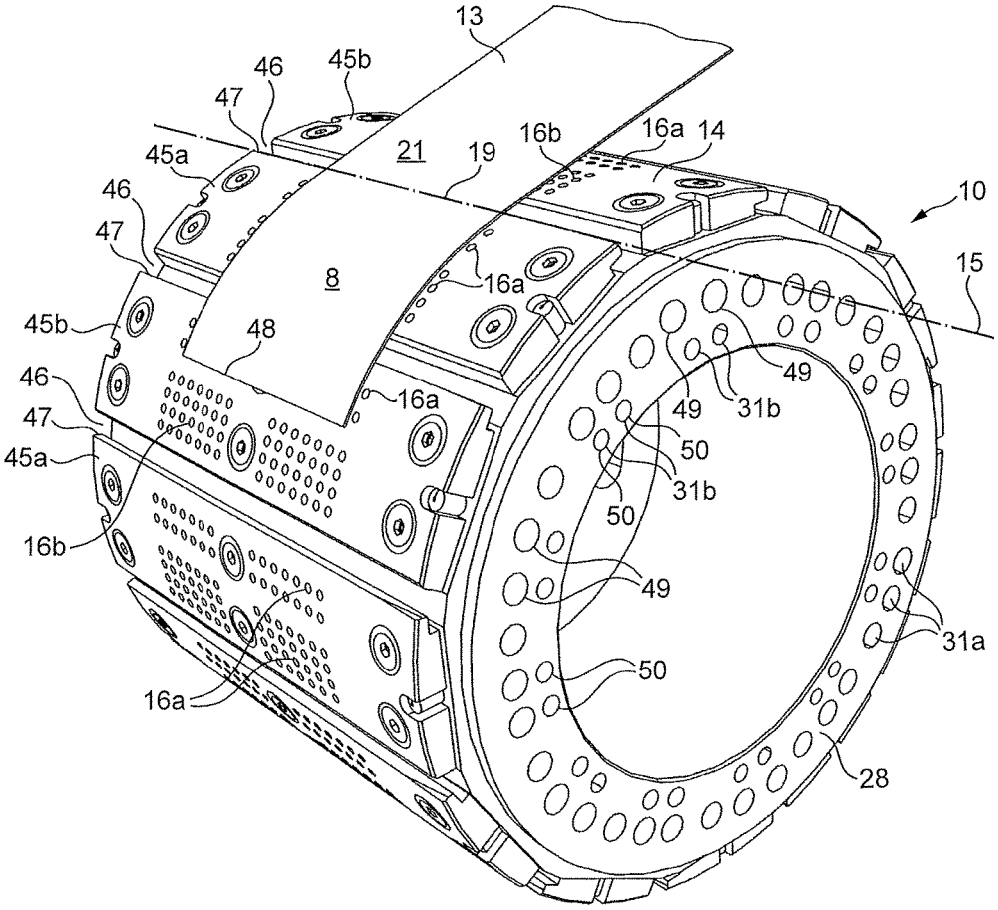

FIG. 9 shows an embodiment of the tipping paper suction drum 10 that shear cuts the tipping paper web 13, as opposed to the crush cutting embodiment previously described.

As shown, the tipping paper suction drum 10 has a series of segments 45 that form the peripheral surface 14 of the tipping paper suction drum 10, against which a web 13 of tipping paper is received. Spaces 46 are formed between adjacent segments 45, which comprise cutting edges 47.

The segments 45 include first segments 45*a* and second segments 45*b*), which are alternately arranged around the tipping paper suction drum 10.

In this embodiment, the cutting unit 12 (see FIG. 1) comprises blades that cooperate with the cutting edges 47 of the first segments 45*a* as the tipping paper suction drum 10 rotates. The blades of the cutting unit 12 (see FIG. 1) slide against the cutting edges 47 of the first segments 45*a*, in the spaces 46, so that the blades and cutting edges 47 overlap to shear cut the tipping paper web 13.

FIG. 9 shows the tipping paper web 13 being received on the peripheral surface 14 of the tipping paper suction drum 10 and a single cut tipping paper patch 8. The tipping paper patch 8 shown in FIG. 9 has just been cut from the web 13 along cut line 15, so that the leading edge 19 of the tipping paper web 13 is now formed at the cut line 15.

In the same manner as explained with reference to the embodiments of FIGS. 3 to 8, the tipping paper suction drum 10 rotates at a speed greater than the speed at which the web 13 of tipping paper, is fed onto the tipping paper suction drum 10, such that a space is formed between successive cut patches 8 of tipping paper.

Specifically, the linear speed of the peripheral surface 14 of the tipping paper suction drum 10 is greater than the linear speed of the web 13. In this way, as each patch 8 is cut by the cutting unit (12, see FIG. 1) the tipping paper suction drum 10 carries that patch 8 away from the leading edge 19 of the web 13. The peripheral surface 14 of the tipping paper suction drum 10 will slide relative to the web 13 and the cutting unit (12, see FIG. 1) is arranged to cut each patch 8 at the appropriate time so that cut patches 8 are retained, on the tipping paper suction drum 10 in a spaced arrangement.

As previously explained, the segments 45 comprise first segments 45*a* and second segments 45*b* that are alternately arranged around the tipping paper suction drum 10 such that the spaces 46 are formed between each adjacent segment 45*a*, 45*b*. In this way, the trailing edge of each of the first segments 45*a* forms a cutting edge 47 against which the tipping paper web 13 is shear cut by the cutting unit 12 (see FIG. 1).

As shown, when a first patch 8 is cut, the leading edge 19 of the tipping paper web 13 is aligned with a cutting edge 47 of a first segment 45*a* and the tipping paper web 13 overlies the upstream second segment 45*b*. However, because the peripheral surface 14 of the tipping paper suction drum 10 is moving more quickly than the tipping paper web 13, when the next patch 8 is cut the leading edge 19 of the tipping paper web 13 will be positioned part-way across a second segment 45*b*, as shown by the position of the leading edge 48 of the cut patch 8.

Therefore, each cut tipping paper patch 8 extends over a first segment 45*a*, over a space 46 between adjacent first and second segments 45*a*, 45*b*, and partially onto the adjacent second segment 45*b*.

As shown in FIG. 9, the first segments 45*a* comprise first suction holes 16*a* that operate in a similar manner to the first suction holes 16*a* described with reference to FIGS. 3 to 8—the first suction holes 16*a* are provided to hold cut patches 8 of tipping paper against the peripheral surface 14 of the tipping paper suction drum 10 and transport them to the point that they are transferred to the tipping drum (7, see FIG. 1).

The second segments 45*b* comprise first suction holes 16*a* and second suction holes 16*b*. The second suction holes 16*b* are provided to pull the leading edge portion 21 of the tipping paper web 13 against the peripheral surface 14 of the tipping paper suction drum 10 in the time between successive cuts being made.

As shown in FIG. 9, at least some of the suction holes 16*a*, 16*b* in each segment 45*a*, 45*b* may be connected to both a first suction channel 31*a* and a second suction channel 31*b*.

The first and second suction channels 31*a*, 31*b* extend to an end face 28 of the tipping paper suction drum 10 and a suction ring, similar to the suction ring 27 described with reference to FIG. 6, is configured to supply suction to the first and second suction channels 31*a*, 31*b* as the tipping paper suction drum 10 rotates.

In this example, the first suction channels 31*a* are arranged around a larger pitch circle diameter on the end face 28 of the tipping paper suction drum 10 than the second suction channels 31*b*. Therefore, it will be appreciated that the suction ring 27 of FIG. 6 is adapted appropriately.

As previously described, the suction ring 27 (see FIG. 6) dictates when suction is applied to the first suction channels 31*a*. and the second suction channels 31*b* as the tipping paper suction drum 10 rotates. The suction ring 27 (see FIG. 6) is configured to supply suction to the second suction channels 31*b* in the time between successive cuts.

The suction ring 27 (see FIG. 6) is also configured to deactivate the suction being applied to the second suction channels 31*b* when the respective second suction holes 16*b* move past the leading edge 19 of the tipping paper web 13.

In this embodiment, at least some of the suction channels 31*a*, 31*b* can be selectively closed, so that the suction holes of each segment 45*a*, 45*b* can be configured to be first suction holes 16*a* or second suction holes 16*b*. This means the first and second segments 45*a*, 45*b*) are interchangeable and the shear cutting unit 12 (see FIG. 1) can cooperate with the cutting edges 47 of the first segments 45*a* or the cutting edges 47 of the second segments 45*b*, depending on the selected configuration.

Therefore, when the cutting edges 47 of the first segments 45*a* become worn, the tipping paper suction drum 10 can be reconfigured to cut the tipping paper web 13 using the second segments 45*b*. This increases the operational time between having to replace or repair the segments 45*a*, 45*b* of the tipping paper suction drum 10.

In a first suction configuration, when the cutting edges 47 of the first segments 45*a* are used to cut the tipping paper web 13, the second suction channels 31*b* associated with the first segments 45*a* are closed, and at least some of the first suction channels 31*a* associated with the second segments 45*b* are closed. Specifically, as shown in FIG. 9, first suction channels 49 and second suction channels 50 are closed.

Therefore, in this configuration, the suction holes 16 of the first segments 45*a* are all configured to act as first suction holes 16*a*, and the second segments 45*b* are configured to have some suction holes 16 that act as first suction holes 16*a* and some suction holes 16 that act as second suction holes 16*b*. In this way, suction is applied to the leading edge portion 21 of the tipping paper web 13, via the second suction holes 16*b* in the second segments 45*b*, in the time between successive cuts being made.

In a second suction configuration, when the cutting edges 47 of the second segments 45*b* are used to cut the tipping paper web 13, at least some of the first suction channels 31*a* associated with the first segments 45*a* are closed, and the second suction channels 31*b* associated with the second segments 45*b* are closed.

Therefore, in this configuration, the suction holes 16 of the second segments 45*b* are all configured to act as first suction holes 16*a*, and the first segments 45*a* are configured to have some suction holes 16 that act as first suction holes 16*a* and some suction holes 16 that act as second suction holes 16*b*. In this way, suction is applied to the leading edge portion 21 of the tipping paper web 13, via the second suction holes 16*b* in the first segments 45*b*, in the time between successive cuts being made.

To change the tipping paper suction drum 10 from the first suction configuration (shown in FIG. 9) to the second suction configuration, the suction channels 31*a*, 31*b* are selectively opened/closed according to the desired configuration. The tipping paper suction drum 10 can then be rotated by the equivalent of one segment 45 relative to the cutting unit 15 so that the blades now cooperate with the cutting edges 47 of the second segments 45*b*.

The relevant suction channels 31*a*, 31*b* can be selectively closed using a blocking member, for example a grub screw, bolt, cap, cover, lid, or insert.

In an alternative embodiment which is not shown in the drawings, the suction control component may comprise a suction control drum, which is fixedly positioned within a cylindrical opening in the tipping paper suction drum. The suction control drum may have a series of first and second recesses on its circumferential face and as the tipping paper suction drum rotates relative to the suction control drum the first and second suction holes will move into and out of alignment with the first and second recesses in the suction control drum. In this case, the first and second suction holes, and thus the associated first and second recesses in the suction control drum, have to be offset from each other in an axial direction. Moreover, the suction control drum may include a third recess provided with a gaseous flow, for example compressed air, and the first suction holes may move into and out of alignment with the third recess as the tipping paper suction drum rotates.

It will also be appreciated that in other embodiments the suction holes can be arranged differently. For example, the first suction holes may only be provided to align with edge portions of the tipping paper patches. In other examples, one, two, three or more rows of second suction holes may be positioned in between each array of first suction holes, depending on the size, of the tipping paper patches and the required space between each patch.

It will be appreciated that the suction supplied to the first and second recesses of the suction control component (the suction ring or control drum) may be provided by a vacuum pump, low pressure reservoir or any other means for generating a pressure which is lower than ambient. Also, the gaseous flow supplied to the third recess of the suction control component may be provided by a compressed air pump, reservoir or other source of gaseous flow.

The second suction holes act to control the leading edge portion of the web of tipping paper immediately after the web is cut. In particular, the leading edge portion of the web is held against the suction drum. Holding the leading edge portion in this way helps to prevent the leading edge portion of the web becoming loose in the time between successive cuts, which might otherwise occur and result in defective smoking articles, especially in the case that longer than usual tipping paper patches are required.

Advantageously, the second suction holes can be deactivated before they are exposed so that suction is not wasted, which would lead to increased energy consumption, loss of suction strength in other suction holes, and increased noise.

The tipping paper patches 8 that are cut on the tipping paper suction drum 10 may have a length which is sufficient to wrap the tipping paper patch 8 at least twice around the filter and tobacco rods 5, 6 when forming smoking articles.

If the length of the tipping paper patches 8 is increased then the length of the leading edge portion 21 of the tipping paper web 13 is also increased. Therefore, it is even more advantageous to provide suction holes 16*b* to control the leading edge portion 21 of the tipping paper web 13 in the time between successive cuts.

As used herein, the term "smoking article" includes smokable products such as cigarettes, cigars and cigarillos whether based on tobacco, tobacco derivatives, expanded tobacco, reconstituted tobacco or tobacco substitutes and also heat-not-burn products. The smoking article may be provided with a filter for the gaseous flow drawn by the smoker.

As used herein, the term "tipping paper" includes any material suitable for attaching the filter to a rod of smokable material and therefore includes any suitable type of paper, metallic foil, or other sheet material.

In order to address various issues and advance the art, the entirety of this disclosure shows by way of illustration various embodiments in which the claimed invention(s) may be practiced and provide for superior assembly comprising a tipping paper suction drum. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. Apparatus comprising a tipping paper suction drum and a cutting unit, the tipping paper suction drum being adapted to receive a web of tipping paper and the cutting unit being adapted to cut the web of tipping paper on the tipping paper suction drum to form successive patches of tipping paper for wrapping smoking articles, the tipping paper suction drum being adapted to rotate at a speed greater than the speed at which the web of tipping paper is fed onto the tipping paper suction drum such that spaces are formed between the cut patches of tipping paper, wherein a peripheral surface of the tipping paper suction drum comprises:

first suction holes arranged to retain the cut patches of tipping paper on the peripheral surface of the suction drum, and second suction holes arranged to pull a leading edge portion of the web of tipping paper towards the peripheral surface of the tipping paper suction drum in the time between successive cuts; and, wherein the apparatus further comprises a suction control component adapted to deactivate suction through said second suction holes as they move past a leading edge of the web of tipping paper.

2. The apparatus of claim 1, wherein the suction control component is adapted so that for at least certain times during rotation of the tipping paper suction drum, suction is applied to either the first suction holes or to the second suction holes.

3. The apparatus of claim 2, wherein each of the first and second suction holes is connected to a suction channel that extends to a second surface of the tipping paper suction drum.

4. The apparatus of claim 3, wherein each suction channel is connected to a row of suction holes extending across the peripheral surface of the tipping paper suction drum.

5. The apparatus of claim 3, wherein the suction control component is disposed at the second surface to provide suction to the suction channels.

6. The apparatus of claim 5, wherein the second surface is an end face of the tipping paper suction drum and the suction control component is disposed at the end face of the tipping paper suction drum such that the tipping paper suction drum rotates relative to the suction control component.

7. The apparatus of claim 6, wherein suction channels are arranged on a pitch circle diameter on the end face of the tipping paper suction drum, and the suction control component comprises a recess that is aligned with suction channels.

8. The apparatus of claim 7, wherein suction channels that are connected to first suction holes are disposed on a different pitch circle diameter to suction channels that are connected to the second suction holes.

9. The apparatus of claim 1, wherein the tipping paper suction drum comprises a plurality of segments that form the peripheral surface of the tipping paper suction drum, and wherein the segments comprise cutting edges adapted to cooperate with a shear cutter to cut the web on the tipping paper suction drum.

10. The apparatus of claim 9, wherein each segment has a configuration of suction channels that can be selectively closed/opened to vary the suction control for that segment.

11. The apparatus of claim 10, wherein at least some suction holes of each segment are connected to both first suction channels and second suction channels, such that said suction holes can be configured to act as first suction holes or second suction holes.

12. A module of a modular smoking article assembly apparatus comprising the apparatus of claim 1.

13. Apparatus for assembling smoking articles comprising the apparatus of claim 1.

14. A method of assembling smoking articles comprising:

feeding a web of tipping paper onto a tipping paper suction drum;

cutting said web to form successive patches;

rotating the tipping paper suction drum at a speed greater than the speed at which the web of tipping paper is fed onto the tipping paper suction drum such that spaces are formed between the cut patches of tipping paper;

applying suction via first suction holes of the tipping paper suction drum arranged to retain the cut patches of tipping paper on the peripheral surface of the drum, and applying suction via second suction holes of the tipping paper suction drum to pull a leading edge portion of the web of tipping paper towards the peripheral surface of the tipping paper suction drum in the time between successive cuts;

assembling a smoking article using a patch cut from the web; and, deactivating the second suction holes associated with the leading portion of the web of tipping paper as they become exposed.

* * * * *